US006206815B1

(12) United States Patent
Focke et al.

(10) Patent No.: US 6,206,815 B1
(45) Date of Patent: Mar. 27, 2001

(54) METHOD AND DEVICE FOR MANUFACTURING HINGE-LID PACKETS

(75) Inventors: Heinz Focke, Verden; Henry Buse, Visselhövede; Thomas Häfker, Langwedel, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/099,219

(22) Filed: Jun. 18, 1998

(30) Foreign Application Priority Data

Jun. 20, 1997 (DE) ..... 197 26 324

(51) Int. Cl.[7] ..... B31B 1/16

(52) U.S. Cl. ..... 493/55; 493/58; 493/62; 493/74; 53/148; 53/202; 53/444

(58) Field of Search ..... 493/55, 58, 62, 493/74; 53/389.3, 444, 202, 148

(56) References Cited

U.S. PATENT DOCUMENTS

| | | | | |
|---|---|---|---|---|
| 3,844,201 | | 10/1974 | Eggert et al. | 93/36 |
| 4,676,047 | * | 6/1987 | Mutoh | 53/133 |
| 4,929,226 | * | 5/1990 | Focke et al. | 493/343 |
| 4,947,617 | * | 8/1990 | Focke et al. | 53/234 |
| 5,052,993 | | 10/1991 | Focke | 493/79 |
| 5,205,505 | * | 4/1993 | Focke et al. | 242/58.6 |
| 5,240,117 | * | 8/1993 | Focke et al. | 209/536 |
| 5,311,800 | * | 5/1994 | Focke et al. | 83/168 |
| 5,316,811 | * | 5/1994 | Focke et al. | 428/43 |
| 5,336,040 | * | 8/1994 | Focke et al. | 414/751 |
| 5,336,154 | * | 8/1994 | Focke et al. | 493/352 |
| 5,365,596 | * | 11/1994 | Dante et al. | 382/8 |
| 5,447,262 | * | 9/1995 | Focke et al. | 226/87 |
| 5,462,223 | * | 10/1995 | Focke et al. | 229/160.1 |
| 5,540,153 | * | 7/1996 | Campbell et al. | 101/493 |
| 5,549,537 | * | 8/1996 | Focke et al. | 493/162 |

FOREIGN PATENT DOCUMENTS

| | | |
|---|---|---|
| 802564 | 1/1951 | (DE) . |
| 2137937 | 5/1973 | (DE) . |
| 2656702 | 6/1978 | (DE) . |
| 3500547 | 7/1986 | (DE) . |
| 3716897 | 12/1988 | (DE) . |
| 40 13 264 | 11/1991 | (DE) . |
| 43 01 169 | 7/1994 | (DE) . |
| 291 692 | 11/1988 | (EP) . |
| 550 406 | 3/1990 | (EP) . |
| 391079 | 10/1990 | (EP) . |
| 693 424 | 7/1994 | (EP) . |
| 2282800 | 4/1995 | (GB) . |

* cited by examiner

*Primary Examiner*—Joseph J. Hail, III
*Assistant Examiner*—William Hong
(74) *Attorney, Agent, or Firm*—Sughrue, Mion, Zinn, Macpeak & Seas, PLLC

(57) ABSTRACT

Blanks (10) made of thin cardboard for hinge-lid packets or similar are produced in the region of a packaging machine. To this end, a material web (19) made of thin cardboard and if necessary partially pre-prepared, is led through a blanks device (20) in the region of the packaging machine. The blanks device (20) can if necessary apply printing (29) to the material web (19) as well as embossing, grooves, punched-out lines, until the blanks (10) are completely produced by a transverse severance cut (32).

4 Claims, 13 Drawing Sheets

10
11
12
13
14
15
16
17
18
19
29
30
32
34
35
61
62

METHOD AND DEVICE FOR MANUFACTURING HINGE-LID PACKETS

BACKGROUND OF THE INVENTION

The invention relates to a method of manufacturing (cigarette) packets of the hinge-lid type by folding blanks made of (thin) cardboard in a packaging machine, the blanks being prepared by stamping and having punched-out lines on them as well as folding lines formed by embossing. In addition, the invention relates to a device for carrying out this method.

Hinge-lid packets are a type of packet for cigarettes which are now common throughout the world. The hinge-lid packets consist of a (lower) packet portion and a lid attached with a hinge to a rear wall of same. In addition, this type of packet includes a collar—likewise made of thin cardboard—which can be connected to the blank for the hinge-lid packet or manufactured from a separate blank.

The blanks for this type of packet have up to now been manufactured separately, especially in a paper factory. The blanks, printed (on one side) and provided with punched-out lines and embossing lines for folding, are delivered as piles of blanks and passed into the packaging machine, usually in shaft-like blanks magazines. The material supply for the packaging machine in respect of the blanks is thus expensive and susceptible to being interrupted.

SUMMARY OF THE INVENTION

The purpose underlying the invention is to improve the supply of packaging machines with blanks made of thin cardboard, especially for the production of hinge-lid packets, in respect of their efficiency and reliability.

In fulfilment of this purpose, the method according to the invention is characterised in that the blanks are manufactured in the region of the packaging machine by being separated from a material web made of (thin) cardboard and are provided by embossing with folding lines and by stamping with punched-out lines, and in that the blanks are then directly or indirectly led to a folding assembly of the packaging machine.

The basic idea of the proposal according to the invention is to produce blanks from thin cardboard for the production of hinge-lid packets directly in the region of the packaging machine, by separating them from a continuous web of material, in the region of which the stretched-out blanks are aligned beside one another transversely. The web of material is drawn from a reel in the region of the packaging machine. To this extent, the supply of material to the packaging machine takes place in an analogous way to the handling of thin packaging material made of paper or foil.

In an optimum solution of the invention, the web of material is led through a blanks assembly. In the region of same, the web of material is provided on the (later) outer side of the hinge-lid packets with the necessary printing. Moreover, as far as this is necessary, embossing can take place in order to form symbols represented by embossing. Finally the material web runs through a stamping and grooving assembly, in the region of which the punched-out lines and folding lines are applied by embossing, namely by making grooves, and the blanks are divided from the material web by transverse severance cuts.

According to the invention, the completed blanks are collected forming stacks and are led via vertical and horizontal conveyors to a blanks magazine on the machine side.

A further special characteristic of the invention consists in the fact that the deformation that has occurred through the material web having been stored in a roll, namely curvatures in the region of the blanks, are removed. To this end, the material web is led through a counter-shaping assembly, especially over deforming rollers. The amount of the counter deformation of the material web can be adjusted according to the invention, according to the measurement of the diameter of the reel. The decreasing diameter of said reel during the use of the packaging material is therefore monitored according to the invention.

The device according to the invention for carrying out the method is an additional device for a packaging machine for hinge-lid packets. It is connected with the packaging machine via vertical and horizontal conveyors.

Further details of the invention relate to the method and the device for manufacturing and processing the blanks for hinge-lid packets, including measures for recognising and removing faulty blanks.

BRIEF DESCRIPTION OF THE DRAWINGS

Embodiments, given by way of example, and details of the method and of the device are explained in greater detail below with the aid of the drawings. These show.

DESCRIPTION OF PREFERRED EMBODIMENTS

Figures 1, 2:
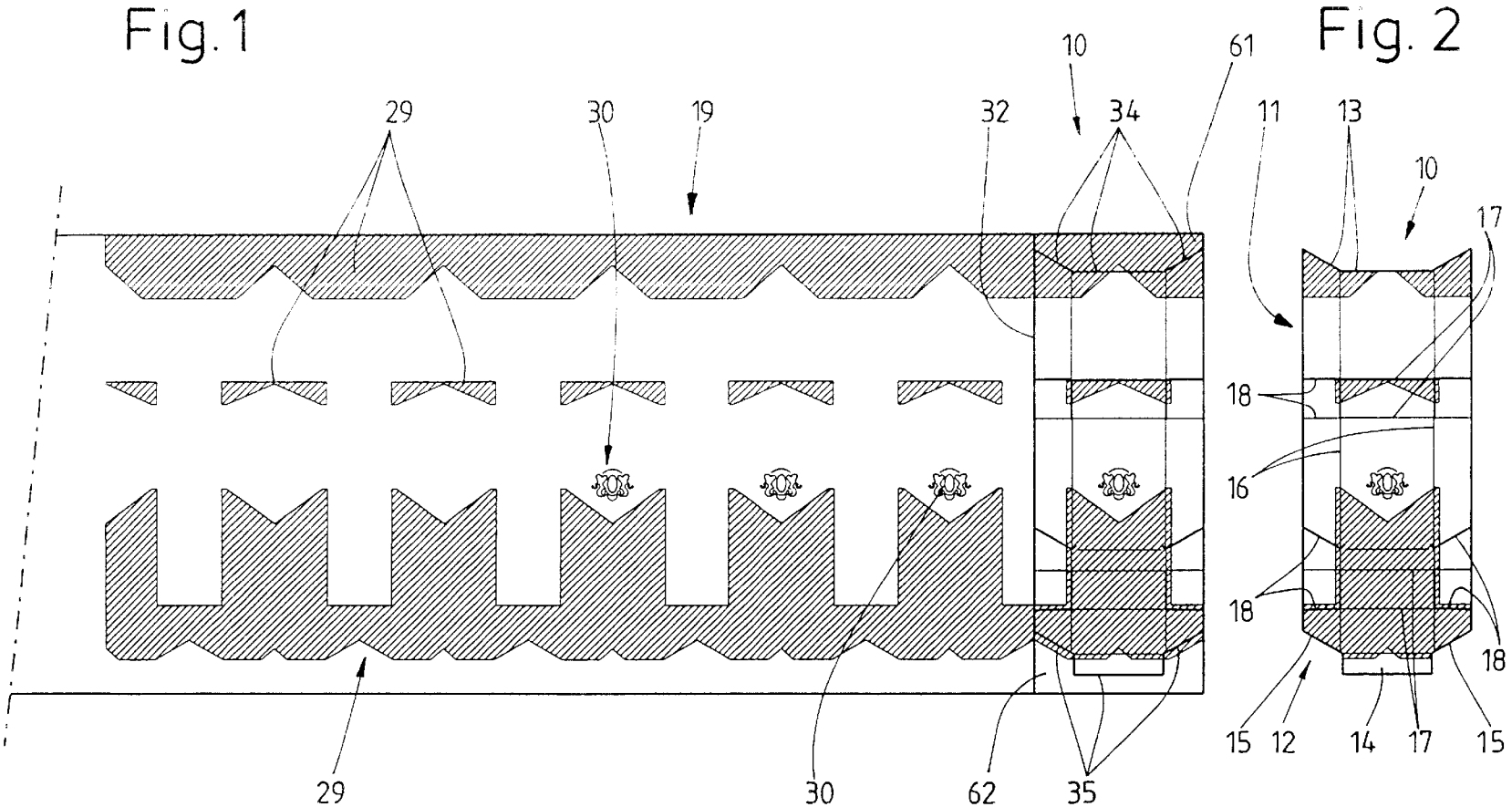
FIG. 1 a section of the material web made of thin cardboard, in plan view.
FIG. 2 a blank for hinge-lid packets, separated from the material web as per FIG. 1, FIG. 3 a packaging machine with a connected blanks device, in simplified plan view, FIG. 4 the packaging machine according to FIG. 3 with the blanks device in side view, on an enlarged scale, FIG. 5 an embodiment of a blanks device, in diagrammatic side view, FIG. 6 a unit of the blanks device in side view, on an enlarged scale, FIG. 7 a blanks station as a detail of the blanks device in side view, on a further enlarged scale, FIG. 8 a distributing station for blanks in side view, on a further enlarged scale, FIG. 9 a cross-section through a detail of the blanks device, in the region of the handling of piles of blanks, FIG. 10 a section of a material web for blanks according to a different manufacturing process, FIG. 11 a packaging machine with a blanks device in diagrammatic plan view for the manufacture of blanks according to the method as per FIG. 10, FIG. 12 a partial region of the device as per FIG. 11 in side view, FIG. 13 the blanks device for the embodiment as per FIG. 11, in simplified, enlarged side view, FIG. 14 a partial region, namely a blanks station of the device according to FIG. 13 on a further enlarged scale.

FIG. 2 shows a blank 10, formed in typical manner, for the production of a hinge-lid packet for cigarettes. The stretched-out blank 10 consists of a partial region for forming a packet portion 11 and of a further partial region for forming a lid 12. Contours at the ends of the blank 10 are characteristic. On the one side is formed a closing edge 13 of the packet portion 11 from a transverse section and side sloping arms, such that a trapezoid edge depression of the blank 10 is produced. On the opposite side in the region of the lid 12, a special contour is produced from a lid inner flap 14 and sloping closing edges 15 of the lid.

In addition, the design of the usable blank 10 is characterised by longitudinal folding lines 16 and transverse folding lines 17. Finally, punched-out lines 18 for delimiting folding flaps in the region of side walls of the hinge-lid packet form part of the typical appearance of the blank 10. A more detailed presentation and description of a blank 10 of this sort for hinge-lid packets arises from U.S. Pat. No. 5,462,223.

Figure 3:
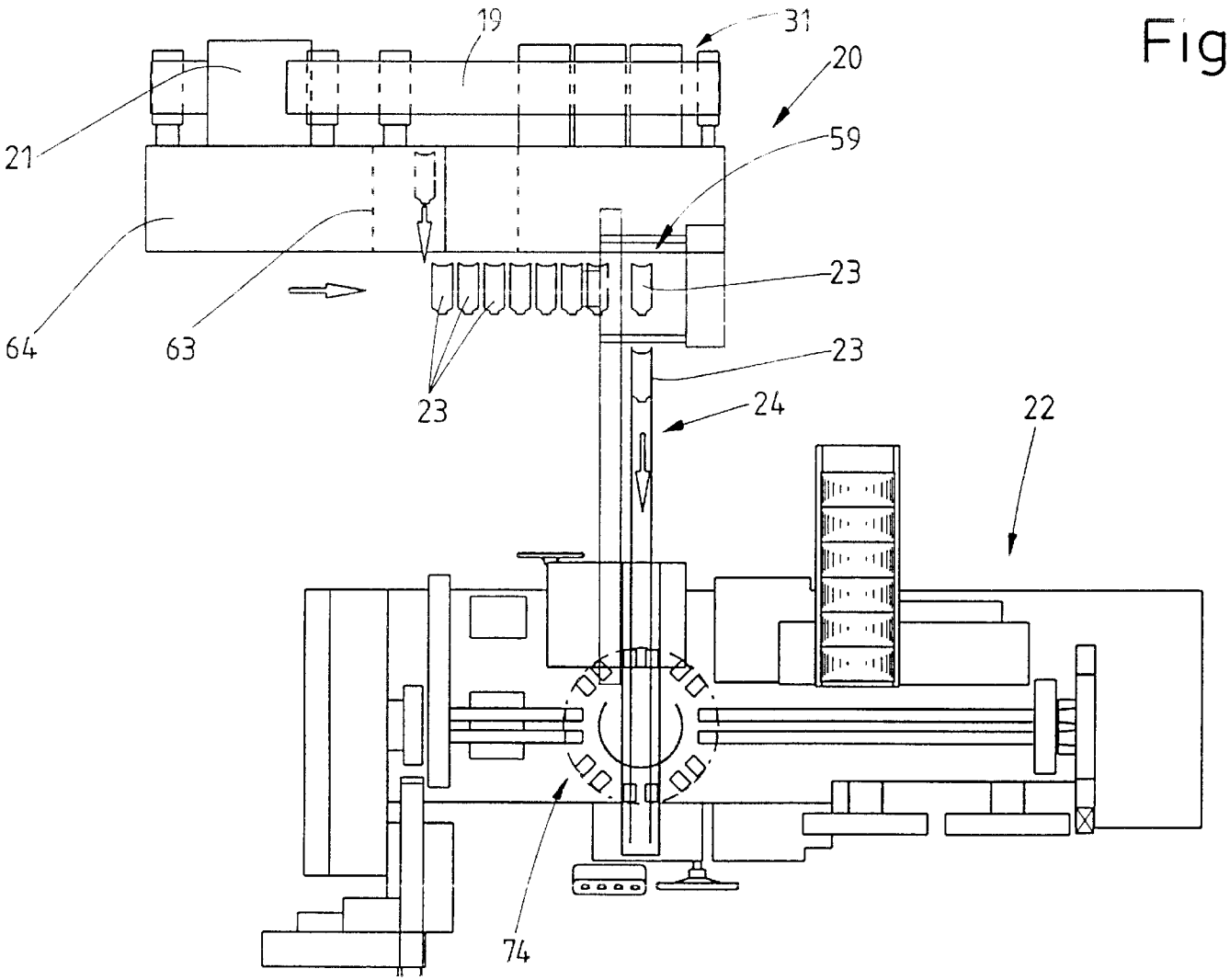
Figure 4:
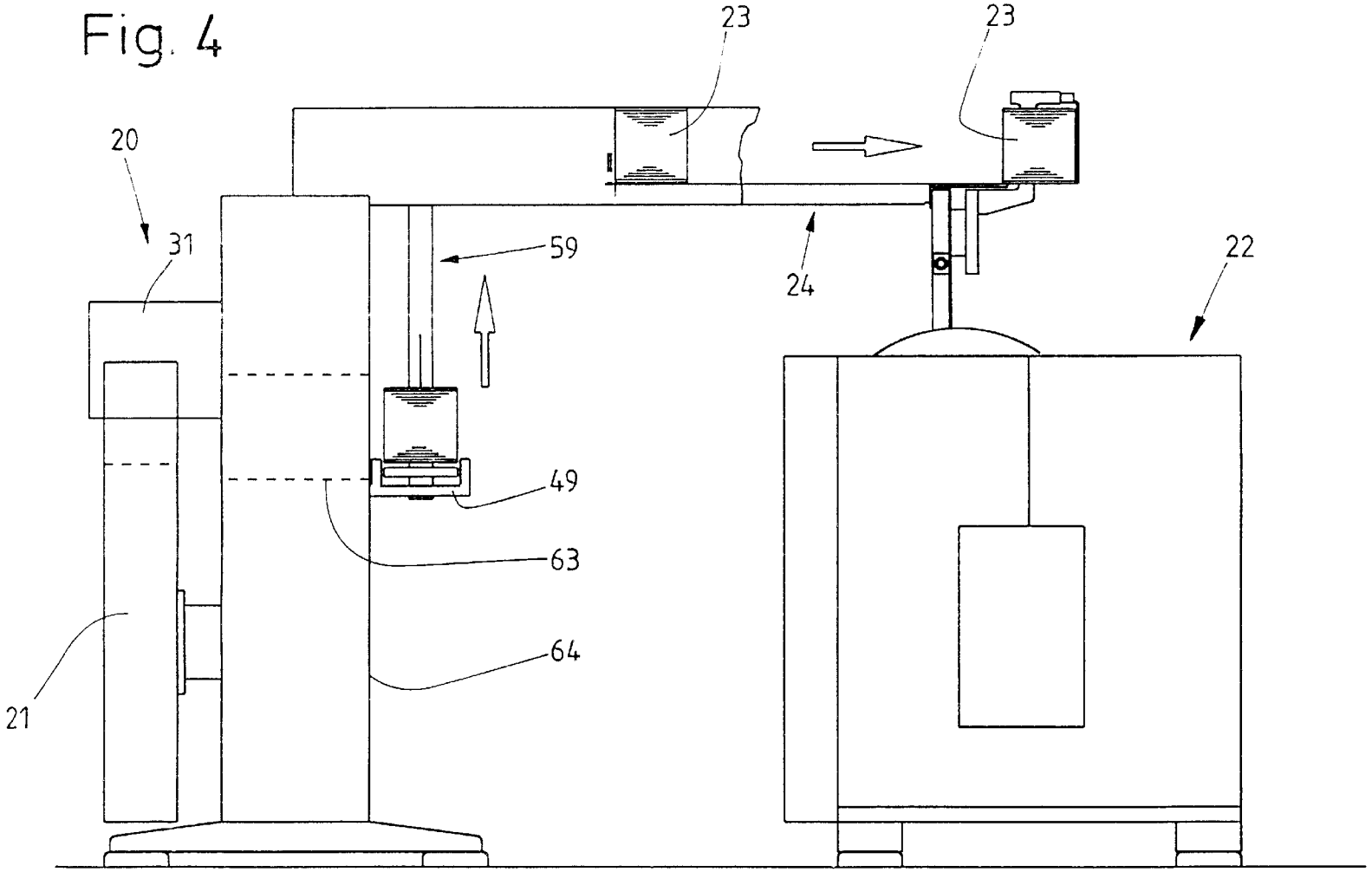
Figure 5:
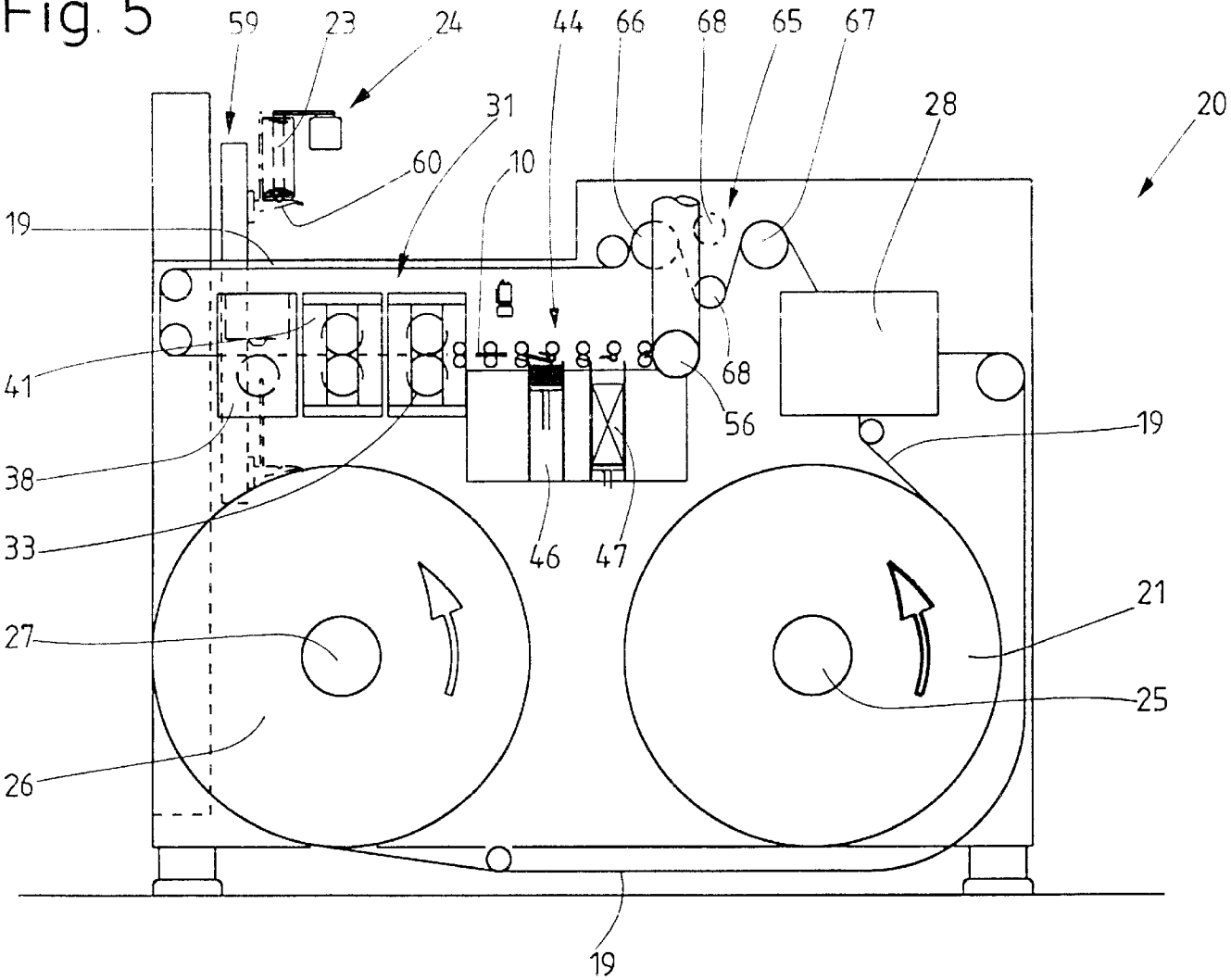

Blanks 10, formed thus or in a similar fashion are separated in succession from a continuous web of material 19. The latter consists of thin cardboard. The material web 19 is drawn from a reel 21 in the region of a blanks device 20 (FIGS. 3, 4, and 5). The blanks device 20 is a machine for producing complete usable blanks 10 for the manufacture of (cigarette) packets of the hinge-lid type, and can also be used independently. The blanks device 20 is here part of a packaging plant or a packaging machine 22 for the manufacture of this special type of packet.

The blanks device 20 is disposed at a distance from the packaging machine 22. The blanks 10 are led as piles 23 of blanks from the blanks device 20 by a horizontal conveyor 24 to the packaging machine 22.

It is important that the material web 19 can be drawn in the region of the blanks device 20 from the reel 21, which is rotatably mounted on a carrying journal 25. Offset to this reel, in (approximately) the same horizontal plane, there is located a spare reel 26 likewise on a carrying journal 27. The spare reel 26 is introduced into the manufacturing process after reel 21 has been used up. The material web 19 is, to this end, led through a splicing assembly 28, shown diagrammatically. In the region of this splicing assembly, there is (automatic) connection of the material web 19 with a new material web which is to be joined on to same.

The material web 19 can be partially prepared (elsewhere) for processing in the region of the blanks device 20. Thus the material web 19 can be already provided with printing 29 (cross-hatched areas in FIG. 1 and FIG. 2) which corresponds to the finished blanks 10. In addition, embossing 30—as far as it is desired on the finished packet—can be applied to the material web 19 in the position that is correct for the packet. Also certain grooves can be present corresponding to folding lines which have to be applied. The preparation of the material web 19 outside the region of the packet production, however, may not impair its ability to be coiled up as a reel.

An important part of the blanks device 20 is a blanks unit 31. In its region, the blanks 10 are first completed within the material web 19 and then separated from same by a transverse severance cut 32.

The blanks unit 31 consists of a plurality of successive working assemblies. Each working assembly undertakes a partial function up to the completion of the blanks 10.

Figure 6:
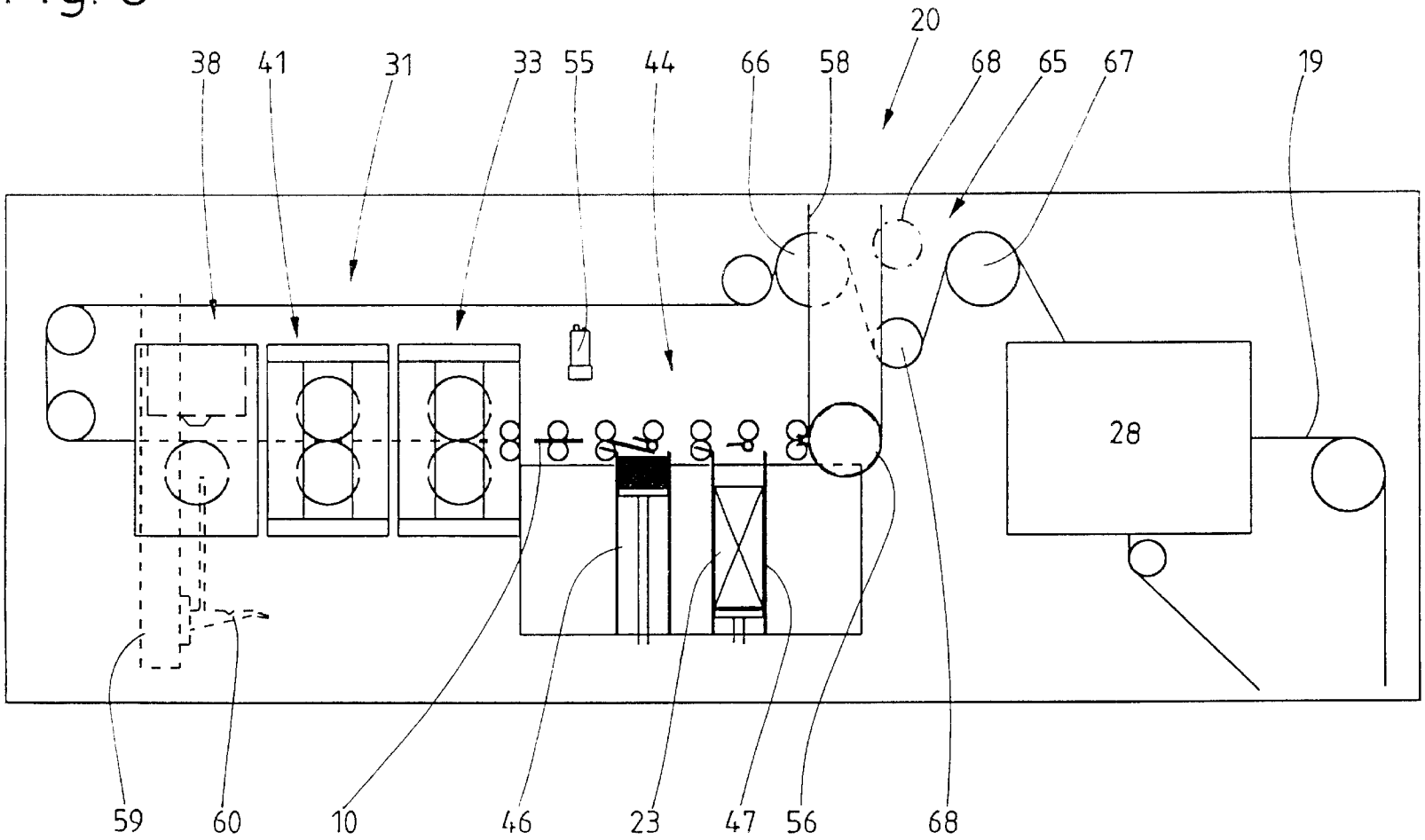
Figure 7:
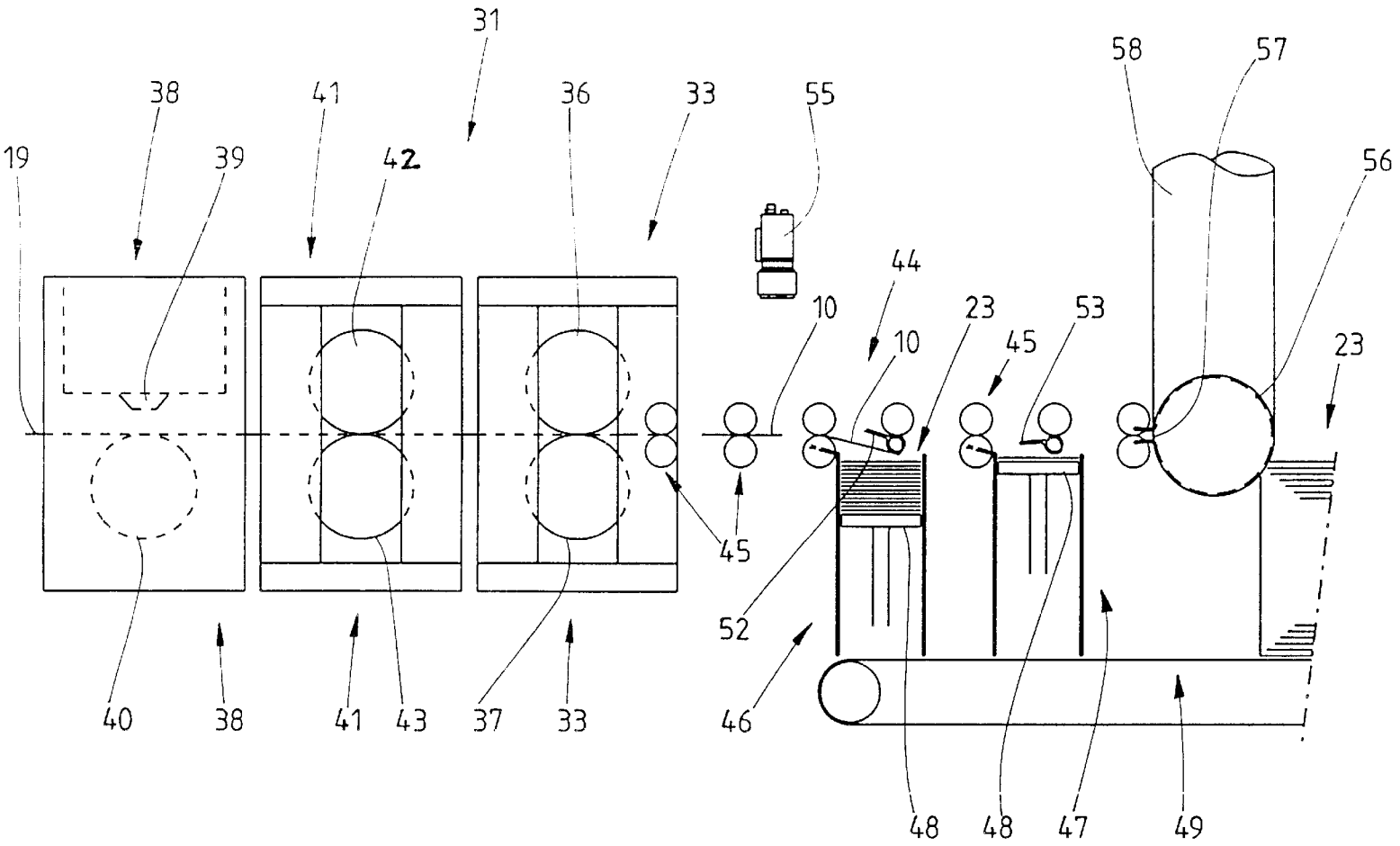

The most important working assembly is a cutting assembly 33 (FIGS. 5, 6, and 7). This is set up in such a way that the material web 19 is provided in its front end region with the punched-out lines 18 and with embossing or grooves to form the longitudinal folding lines 16 and transverse folding lines 17 (FIG. 2). Additionally in this region, the end contours of the blanks 10 aligned transversely to the web of material 19 are manufactured by a contoured longitudinal cut 34, 35 on both longitudinal sides of the material web 19. Finally, the cutting assembly 33 carries out the transverse severance cut 32. In the region of the cutting assembly 33, the blank 10 is correspondingly completed—up to the printing 29 and any possible embossing 30.

The material web 19 is of greater dimensions than that of the (transverse) blanks 10. Thus in the region of the cutting assembly 33, on both side edges of the material web 19, a piece of material 61, 62 (FIG. 1) is cut off, which extends in each case as far as the edge of the material web 19 and has the respective contour of a blank 10. Thus on the one side, namely in the region of the longitudinal cut 34, a trapezoid piece of material 61 is formed. On the opposite side, in the region of the lid inner flap 14, an approximately U-shaped piece of material 62 is cut off. These pieces of material 61, 62 are cut off immediately before the transverse severance cut 32, in such a way that the blank 10 shown in FIG. 2 is present. The printing 29 is so applied that the longitudinal cuts 34, 35—with corresponding design of the blank 10 or of the packet—run inside the printing 29.

In order to carry out these measures, the cutting assembly 33 is provided with working rollers 36, 37 which are co-ordinated with one another, and which are configured as cutting and embossing rollers in the distribution of tasks described. The described steps are carried out during the (continuous) passage of the material web 19.

If—as in the present embodiment—an untreated web of material 19 is made available, the blanks unit 31 is equipped with additional working assemblies, which are placed in front of the cutting assembly 33 in the direction of conveying. Thereafter the material web 19 runs first of all through a printing assembly 38. In the region of same, the printing 29 is applied in the correct position for the packet whilst the material web 19 is conveyed continuously. The printing assembly 38 consists substantially of an upper printing unit 39 and a lower supporting roller 40.

The material web 19, provided for example in the embodiment as per FIG. 1 with printing 29, runs here through a further working assembly, namely an embossing assembly 41. This supplies embossing, likewise in the position which is correct for the packet, for example coats of arms or other emblems. The embossing assembly 41 consists essentially of two co-operating embossing rollers 42, 43, between which the material web runs.

The blanks 10, emerging ready to use out of the blanks unit 31, are collected, forming piles of blanks 23. To this end there is a (horizontal) blanks path 44 joining on to the blanks unit 31. This path consists of a plurality of pairs of rollers 45 which are driven to carry the blanks 10 in a transverse direction. The distances between the pairs of rollers 45 are slightly smaller than the measurement of the blanks 10 in the conveying direction.

Figure 9:
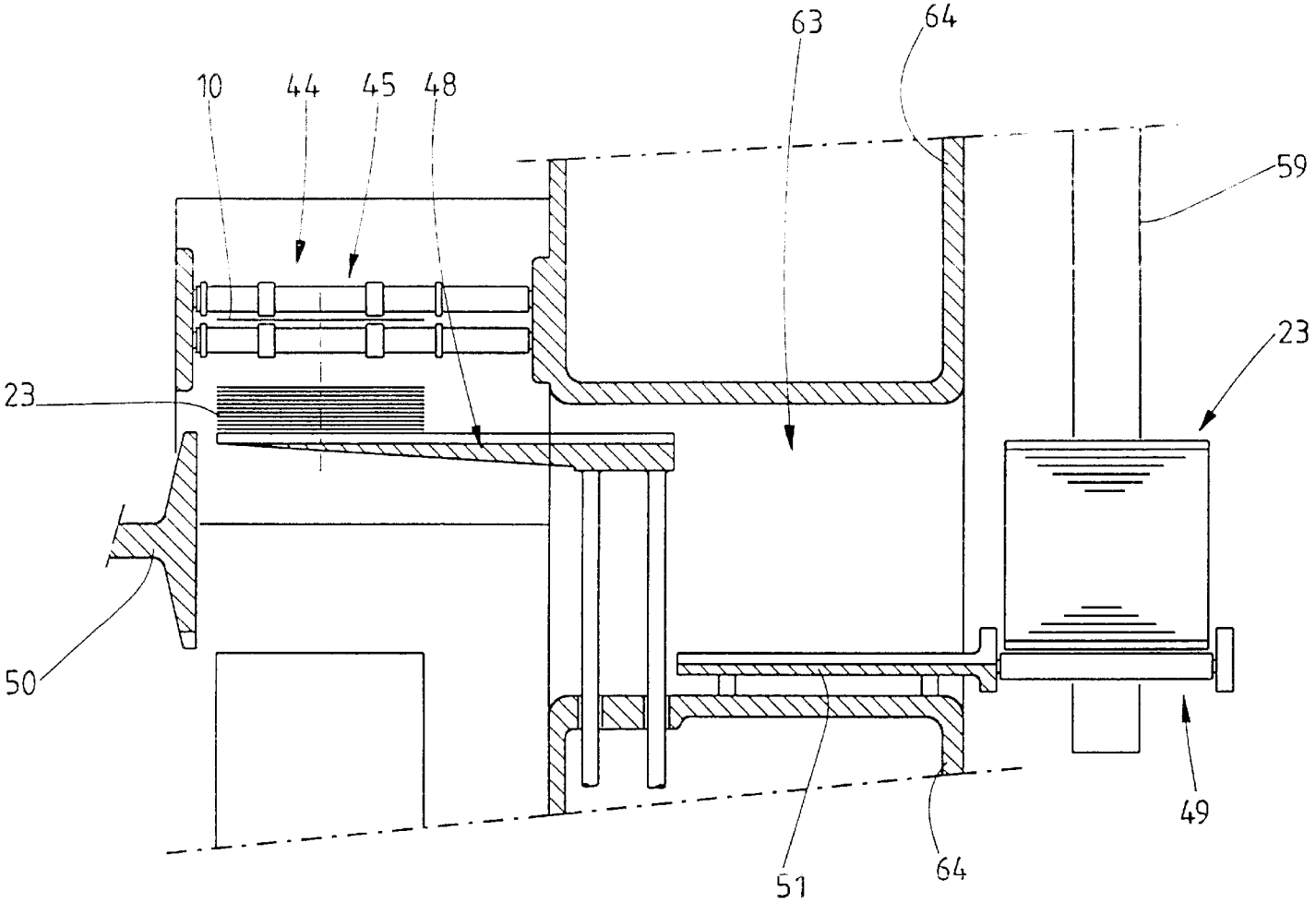

Stackers 46, 47 are arranged in the region of the blanks station. These are containers which are open at the top and on narrow sides and into which the blanks 10 may be conveyed in succession from above. The blanks are laid in the stacker 46, 47 respectively on a carrying plate 48 which is adjustable in height. This plate is lowered in accordance with the increasing height of the pile 23 of blanks formed in the stacker 46, 47. The carrying plate 48 enters the stacker 46, 47 via an open side. In a lower position, the carrying plate is located at the height of a conveyor 49 for piles of blanks, a belt conveyor. In this lower position of the carrying plate 48, the pile 23 of blanks in the stacker 46, 47 is complete. A slide 50 (FIG. 9) entering the stacker 46, 47 via an open side, pushes the pile 23 of blanks out of the stacker 46, 47 on to the conveyor 49 for the piles of blanks.

On the present embodiment, a fixed bridge plate 51 is disposed between the conveyor for the piles of blanks 49 and the carrying plate 48. This bridge plate extends at the height of a bight of the conveyor for the piles of blanks. The carrying plate 48 is lowered during the filling process of the stacker 46, 47 to the level of the bridge plate 51. When this position is reached, the pile 23 of blanks is pushed by the slide 50 over the bridge plate 51 on to the conveyor 49 for the piles of blanks.

The bridge plate 51 is the lower delimitation of a recess 63 in an upright supporting housing 64 of the blanks device 20. The piles 23 of blanks are—lying on the bridge plate 51—pushed through the recess 63 on to the conveyor 49 for the piles of blanks which is arranged beside the supporting housing 64.

Figure 8:
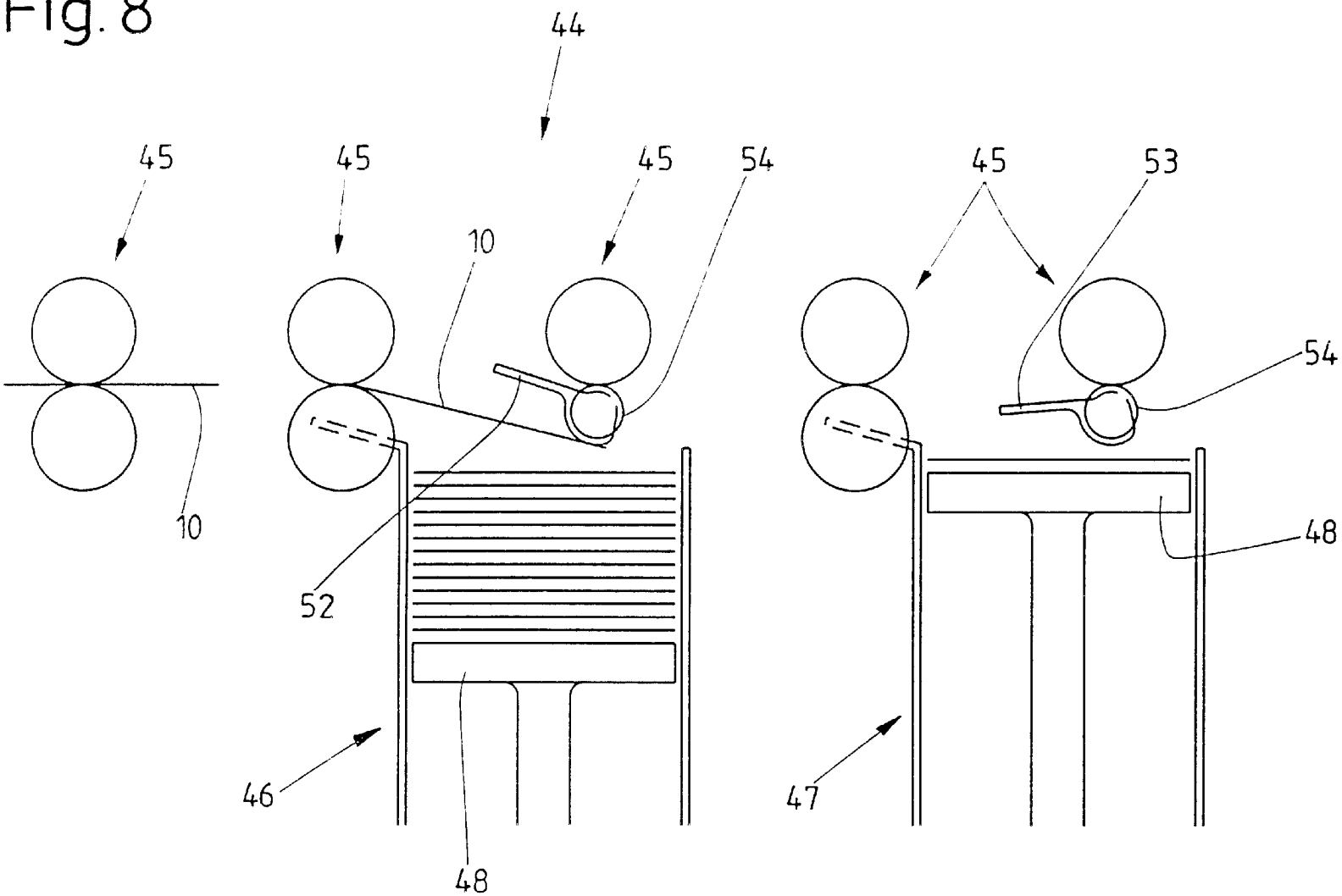

In order to introduce the blanks 10 into one or the other stacker 46, 47 guide members are positioned in the region of the blanks path 44. These members are swivellable guide plates 52, 53 above each stacker 46, 47. In an upwardly aligned sloping position (stacker 46 in FIG. 7 and FIG. 8) the arriving blanks are led by the guide plate 52 into the associated stacker 46. In a horizontal position or one aligned obliquely downwards (stacker 47 in FIG. 7 and FIG. 8), the arriving blank 10 is guided past the relevant stacker 46, 47 to the next stacker or to another member. The guide plates 52, 53 are in the present case mounted coaxially with a lower counter-roller 54 of a pair of rollers 45 above the respective stacker 46, 47 but may, however, be swivelled independently of these counter rollers 54.

The blanks 10 produced in the region of the blanks unit 31 are checked to see that they are correctly configured. To this end, a monitoring device for blanks 10 is disposed at the exit side of the blanks unit 31 above the blanks path 44. In the present case, this monitoring device is a camera 55 which monitors the blanks to see that they have the correct printing and other details. The camera 55—or a different monitoring device—controls the guide plates 52, 53.

A faulty blank 10 is conveyed through the blanks path 44 and separated outside the region of the stackers 46, 47. On the embodiment shown, faulty blanks of this sort are led into a collecting vessel 56. The latter is configured here as a pipe-shaped container with an entrance slot 57 on the side facing the blanks path 44. The collecting vessel 56 is collected via an extraction pipe 58 with a source of negative pressure. Faulty blanks entering the collecting vessel 56—preferably a horizontal section of pipe—are carried away via the extraction pipe 58.

The piles 23 of blanks, set down on the conveyor 49 for these piles, are transferred to a vertical conveyor 59 in the region of the blanks device 20. The vertical conveyor 59 in each case picks up one pile 23 of blanks on a platform 60. By a forward movement of same, the pile 23 of blanks is raised up to the plane of the horizontal conveyor 24 and transferred to same. The horizontal conveyor 24 extends at a higher plane. The piles 23 of blanks are led from the horizontal conveyor 24 to a blanks magazine in the region of the packaging machine 22.

A special characteristic of the blanks device 20 consists in the fact that the curvature in the region of the blanks 10, caused by the coiled form of the material web 19, i.e. by the reels 21, 26, is recognized and appropriately compensated, such that flat blanks can be produced. In concrete terms, to this end the material web 19, after it has been drawn from the reel 21 or 26, is treated in a deforming sense, before the web of material 19 runs into the blanks unit 31.

To this end, the material web—following on to the splicing assembly 28—is led via a shaping assembly 65. The latter consists of two stationary deflection rollers 66 and 67 and of a shaping roller 68 arranged between same. The shaping roller is disposed in such a way that the material web running over said shaping roller 68 is deformed against the curvature caused by the reels 21, 26.

The extent or the intensity of the compensatory deformation of the material web 19 may be altered, in accordance with the respective deformation of the material web 19. To this end, the diameter of the respectively running reel 21 is scanned by appropriate known sensors, and the compensatory deformation is controlled in accordance with these. With increasing use of the reel 21, the material web 19 has greater deformation. Correspondingly, the shaping roller 68 may be adjusted in relation to the deflection rollers 66, 67, through upward and downward movement. The upper position, which can be seen in broken lines in FIG. 5, causes slight compensatory deformation. The lower position shown causes stronger or maximum compensatory deformation of the material web 19.

A modified method or a different embodiment of a blanks device 20 is shown in FIG. 10 to FIG. 14. In this solution, individual blanks 10 are not produced in the region of a blanks unit 69. Rather, a web 70 of blanks still adhering to one another emerges from the blanks unit 69. This web of blanks 70 is configured in accordance with EP 291 692 or similar. The blanks 10 are connected to one another in the region of an (incomplete) severance cut 32, by a plurality of residual connections 71. These are thin or narrow material webs which occur through corresponding interruptions of the severance cut 32. The residual connections 71 can be distributed in an appropriate manner over the length of the blanks 10 or the width of the blanks web 70, to guarantee a continuous web of blanks 70. Otherwise the blanks web 70 is produced like the blanks 10 in the preceding embodiment. This is especially true of the printing, and of embossing, grooves and punched-out lines.

The continuous web of blanks 70 is led through a severance assembly 72. In the region of same, the individual blanks 10 are separated from the web of blank 70, the residual connections 71 being severed, by cutting or tearing. On the present embodiment, it is not individual blanks 10 which are divided from the web of blanks 70, but in each case two blanks 10 still adhering to one another, i.e. a pair of blanks 73.

These blanks units, i.e. pairs of blanks 73 are then led by a corresponding conveyor into the packaging machine 22. In the region of same, the blanks of each pair 73 are separated from one another by tearing, shearing off or by a severance cut and led directly into pockets of a rotary folding unit 74. To this extent, the principle of this solution corresponds to EP 312 877.

On the present embodiment, the web of blanks 70 is introduced into a web store 75. Inside same, a store is formed by zigzag shaped folding of the web of blanks 70, the folding taking place in each case in the region of the residual connections 71. The zigzag-shaped web store is formed between (upper and lower) storage belts 76, 77. The web store 75 is broken down by the web of blanks 70 being drawn out at one open side from the region of the storage belts 76, 77 and brought back into an extended position, by a pair of drawing rollers 78.

At the entrance side of the web store 75 or of the storage belts 76, 77, there is located a member for forming the zigzag shape of the web of blanks 70. These are guide rollers 79, 80. In respect of this detail as well as in respect of the design of the web store 75, reference is made to EP 391 118.

The blanks 10 or the pairs of blanks 73 are separated from the web of blanks 70 in the region of the severance assembly 72 by a tearing process. To this end, two co-operating separating rollers 81, 82 are provided. These are driven to rotate, at a higher speed than the drawing rollers 78. Accordingly, the latter hold the subsequent web of blanks 70 tight when the severance rollers 81, 82 equipped with radially-projecting segments 83, grasp at a higher rotational speed the respectively front blank 10 or the front pair of blanks 73 with segments 83 and separate them from the web of blanks 70.

The blanks 10 or pairs of blanks 73 are transferred to a transverse conveyor 84 which carries the pairs of blanks 73 away in the described manner to the packaging machine 22.

The present embodiment of the blanks device 20 is also configured differently in respect of the arrangement of the reel 21 and of the spare reel 26. A rocker 85 serves as carrying member for the bobbins 21, 26. One reel 21, 26 is rotatably mounted at each of its ends, between facing carrying bodies 86, 87. These are conical peg-like members which enter partially into a central aperture 88 of the reel 21, 26. The carrying bodies 86, 87 are rotatably mounted and lie under pressure on or in the central apertures 88. The rocker 85 consists of two rocker arms 89, 90 at the ends of which the carrying bodies 86, 87 are attached.

The (double-armed) rocker 85 is mounted rotatably on a portal-like carrying frame 91. A pivot bearing 92 is located in the region of upright supports 93 of the carrying frame 91. The latter consists of carrying portals, arranged at a spacing from one another, such that one pivot bearing 92 is formed on each of two facing supports 93 for respectively one rocker arm 89, 90. A centrally-positioned motor 94 provides the rotary drive for the rocker 85, in such a way that respectively the upper reel is active, from which the material web 21 is drawn.

Further details of the device are configured analogously to the preceding embodiment. This is especially true also for the shaping assembly 65. A track link 95 is arranged in front of the latter in the direction of conveying in order to balance out track tensions.

Figure 10:
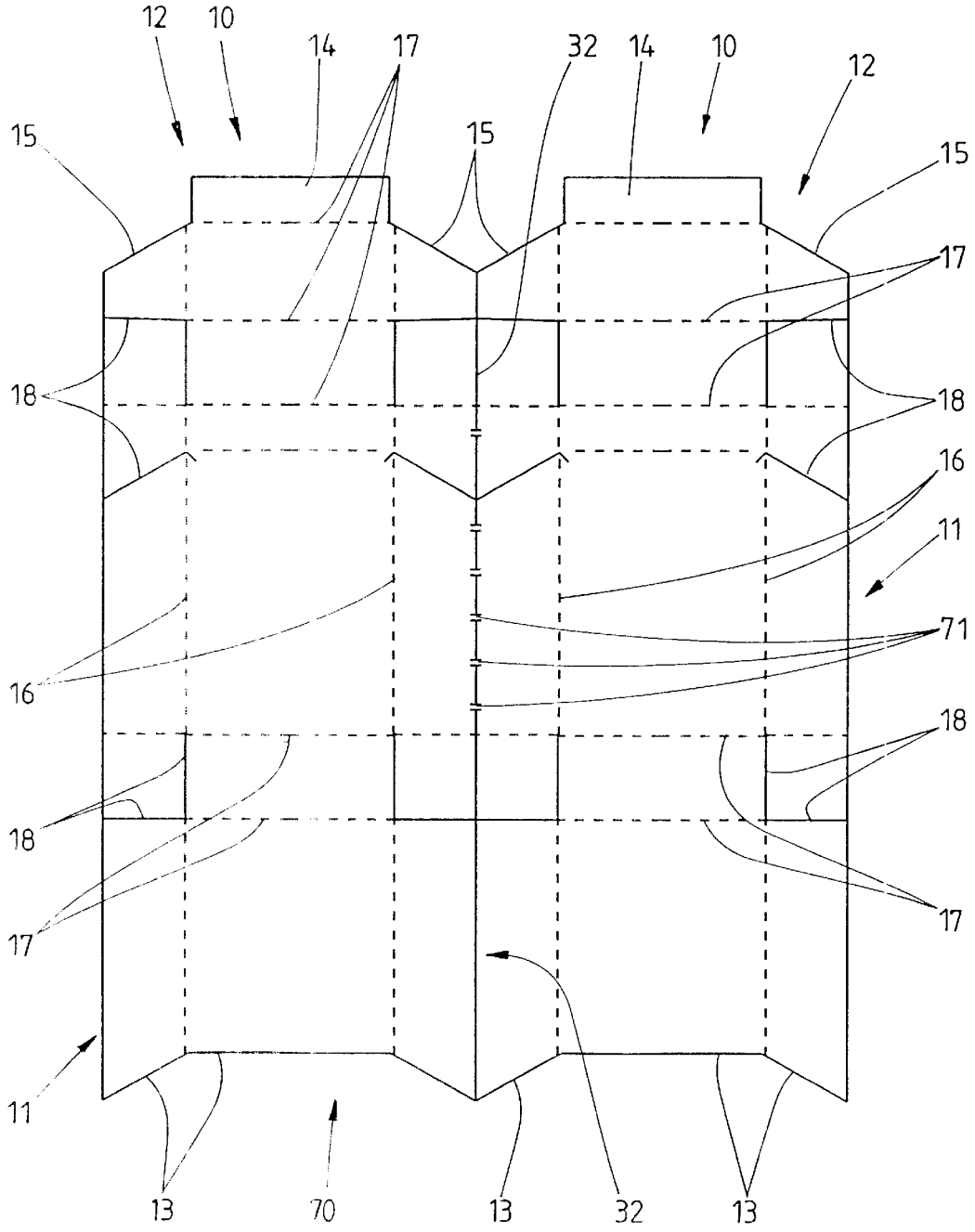
Figure 11:
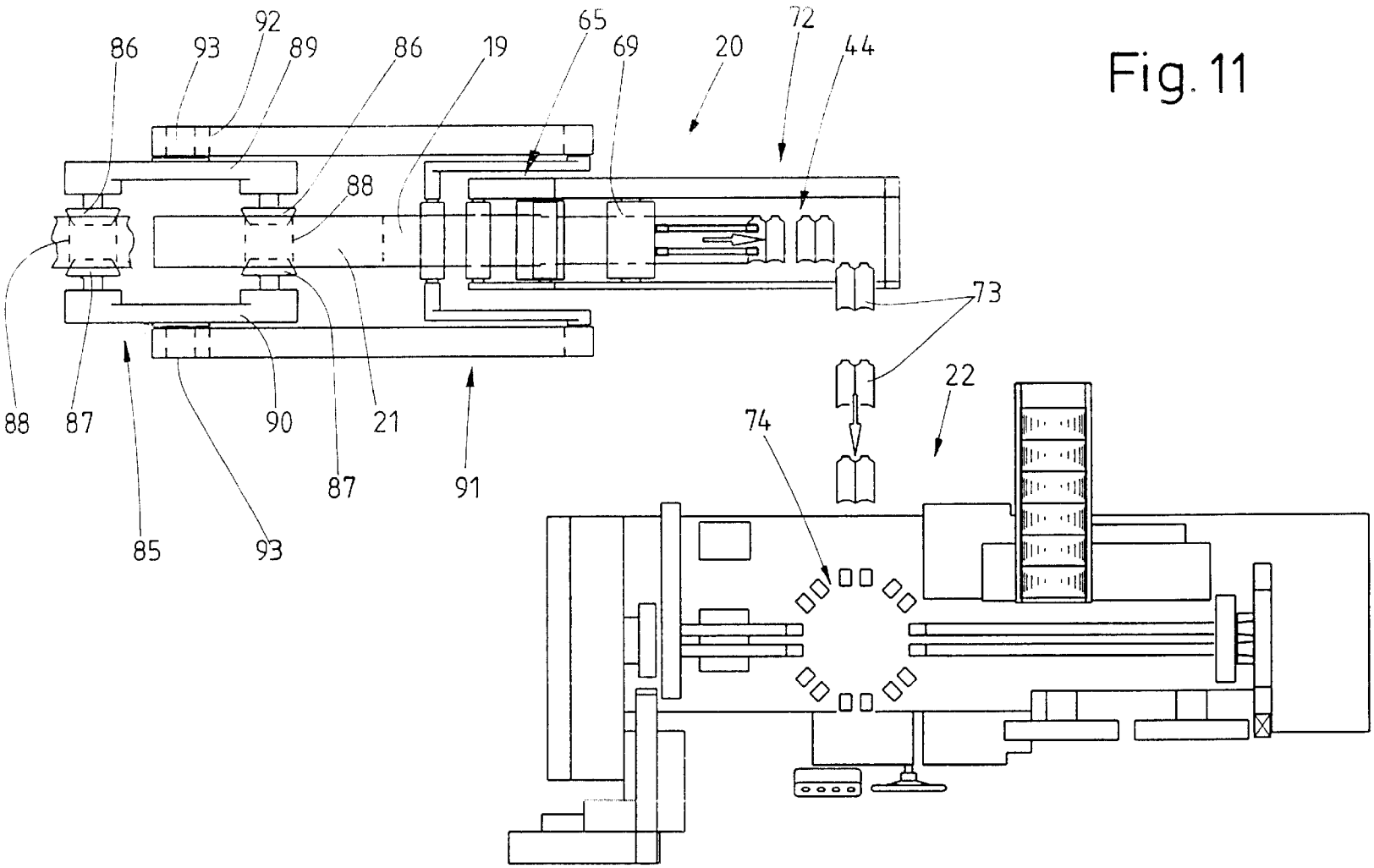
Figure 12:
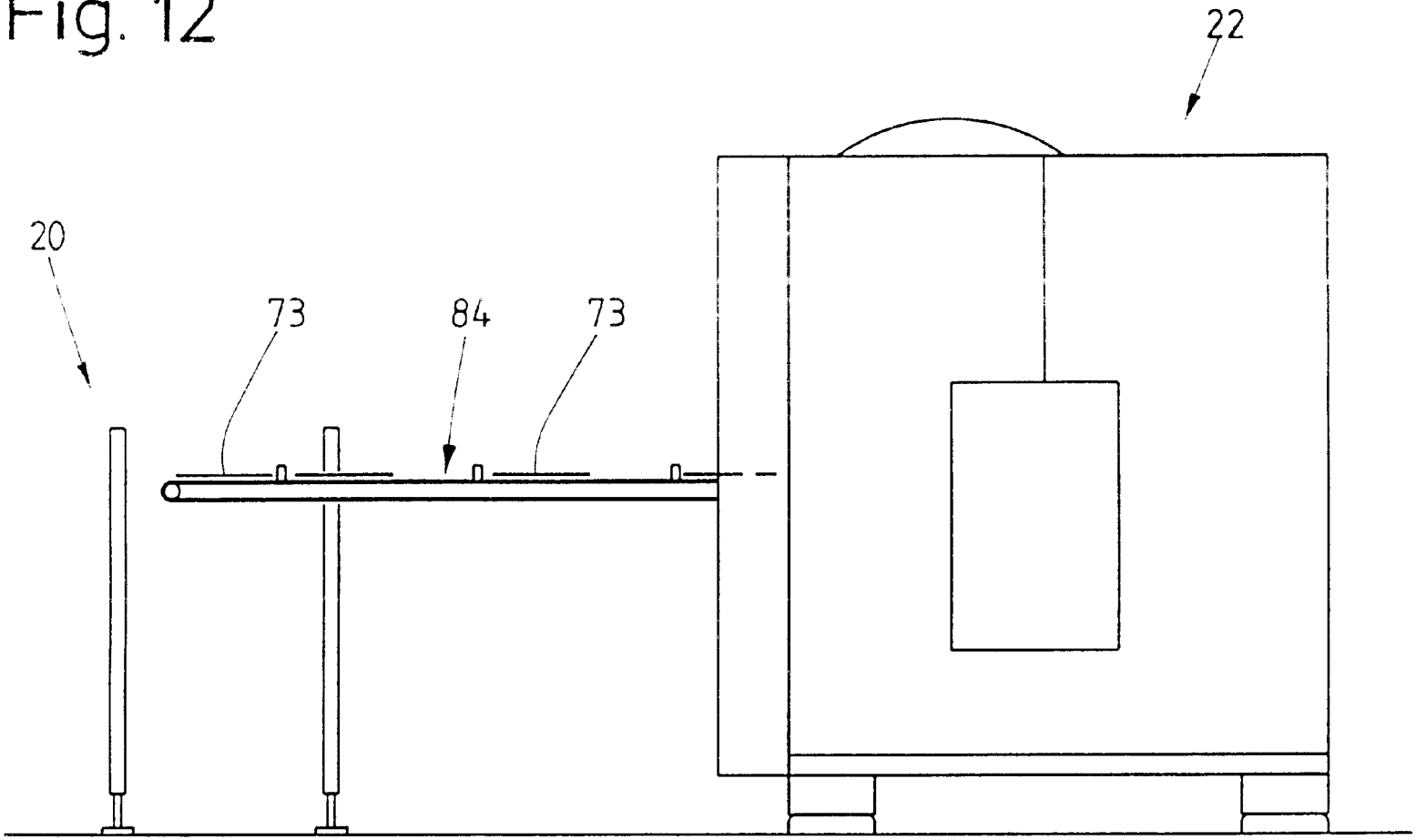
Figure 13:
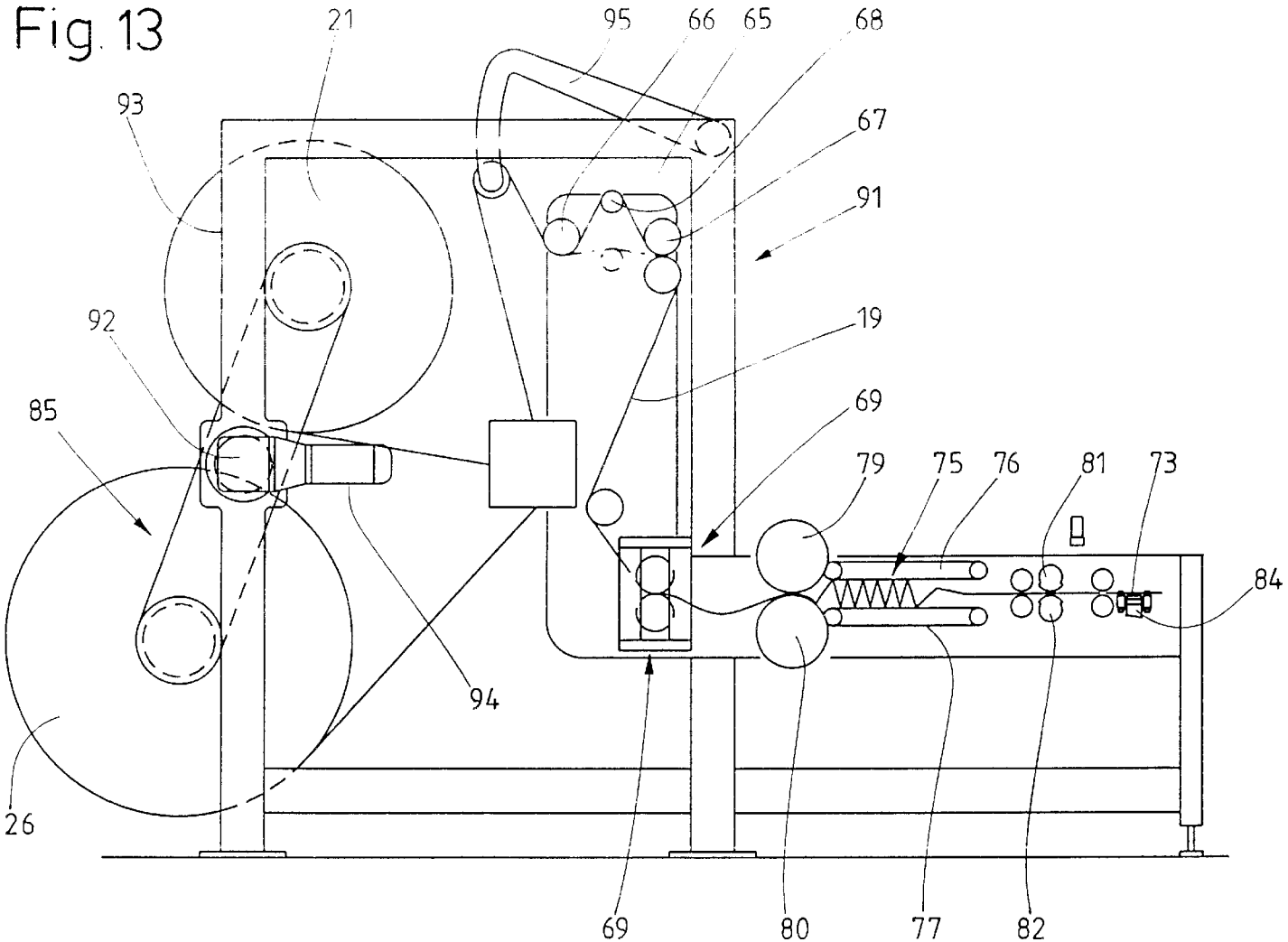
Figure 14:
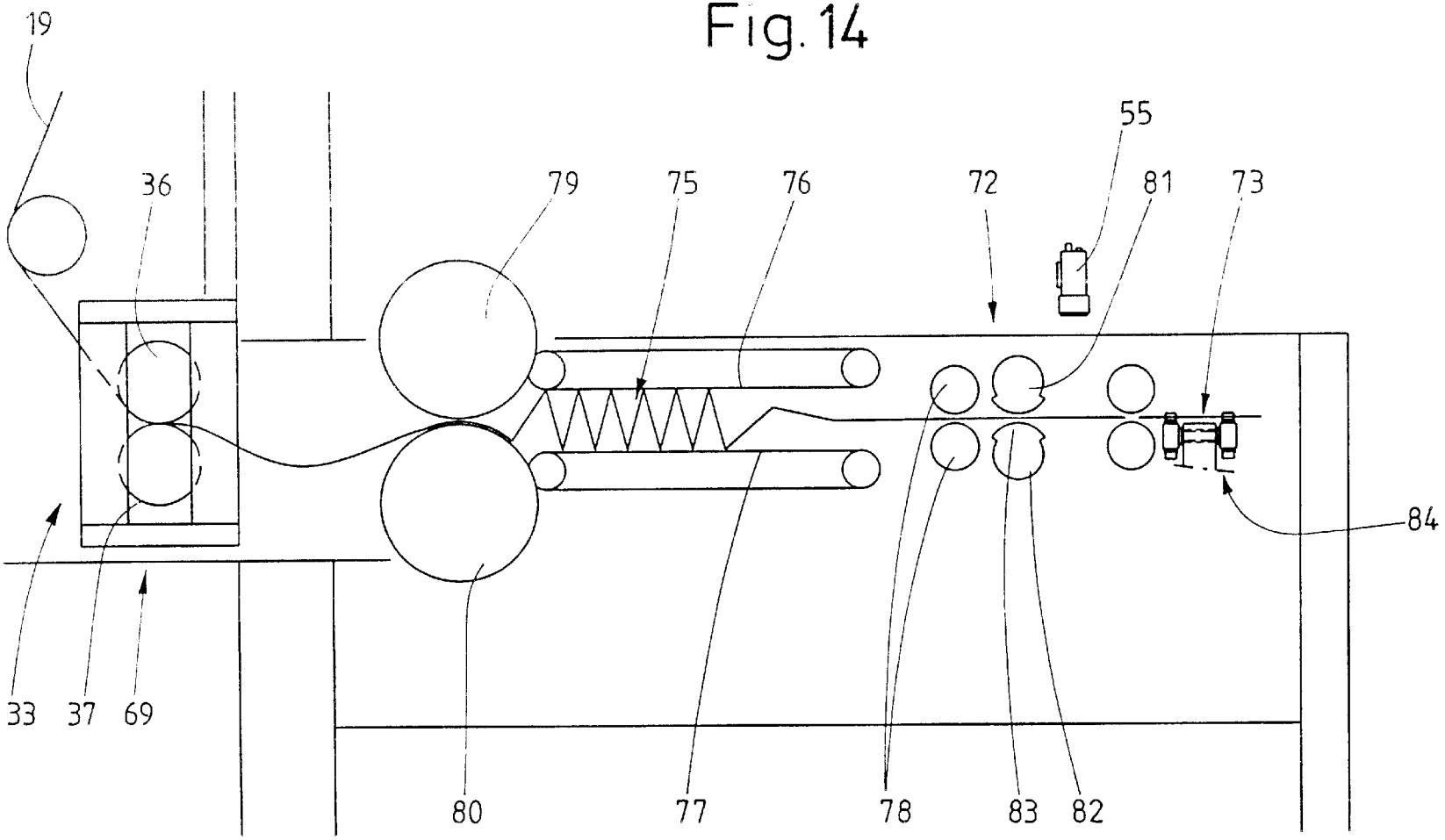

Also on the embodiment according to FIGS. 10 ff., printing 29 and/or embossing 30 can be applied elsewhere or in the region of a correspondingly configured blanks unit 69.

The described device is also suitable for the manufacture and processing of other forms of embodiments of blanks or packets. In addition, the material web for producing the blanks can be prepared externally in various ways. However the ability of the material web to coil must be guaranteed.

What is claimed is:

1. A method of manufacturing cigarette packs of the hinge-lid type by folding cardboard blanks (10) in a packaging machine (22), the blanks (10) being prepared by stamping and having folding tabs defined by punched-out lines (18) and by folding lines (16, 17) formed by embossing, said method comprising the steps of:

a) positioning, in a region of the packaging machine, an elongated web (19) made of cardboard and wound up as a reel (21);

b) applying to the web (19), on one side thereof, printing (29) corresponding to an outer design of a hinge-lid pack, during formation of blanks (10) which are lying adjacent to one another in the web and which have a longitudinal dimension extending transversely to the elongated web (19);

c) applying the printing (29) so that it is oriented transversely to the longitudinal direction of the elongated web (19) within each blank, such that printings for a box part (11) and a lid part (12) of each blank follow one another in the transverse direction of the web (19);

d) feeding the web (19) in a continuous conveying motion to one of plural blank-forming units (31) of the packaging machine (22);

e) within the blank-forming unit (31), first embossing the web (19) to form plural folding lines (16, 17) of the blanks (10) to be produced, said plural folding lines comprising longitudinal folding lines (16) running transverse to the longitudinal direction of the web (19) and transverse folding lines (17) running in the direction of the web (19);

f) then, making punched-out lines (18) in the web (19) to form folding tabs and, at the same time, a transverse severing cut (32) for separating each blank (10) from the web (19);

g) choosing the web (19) to be greater in width than the longitudinal dimension of the blanks (10), producing contours of the blanks (10) on both longitudinal edges of the web (19) by contoured longitudinal cuts (34, 35), and cutting off corresponding residual pieces (61, 62) of the web while the punched-out lines (18) are made;

h) then, removing the blanks (10), from the web;

i) feeding the removed blanks (10) to a collecting station within which piles (23) of blanks are formed from successively incoming blanks (10); and j) then, feeding the piles (23) of blanks to the packaging machine (22).

2. The method according to claim 1, wherein before it is fed to the blank-forming unit (31), the web (19) drawn off a reel (21, 26) is subjected to counter-shaping in a decurling unit (65) to remove from the web (19) or blanks (10) a curvature caused by the coiling of the web on reels (21, 26).

3. A method of manufacturing cigarette packs of the hinge-lid type by folding cardboard blanks (10) in a packaging machine (22), the blanks (10) being prepared by stamping and having folding tabs defined by punched-out lines (18) and by folding lines (16, 17) formed by embossing, said method comprising the steps of:

a) positioning, in a region of the packaging machine, an elongated web (19) made of cardboard and wound up as a reel (21);

b) applying to the web (19), on one side thereof, printing (29) corresponding to an outer design of a hinge-lid pack, during formation of blanks (10) which are lying adjacent to one another in the web and which have a longitudinal dimension extending transversely to the elongated web (19);

c) applying the printing (29) so that it is oriented transversely to the longitudinal direction of the elongated web (19) within each blank, such that printings for a box part (11) and a lid part (12) of each blank follow one another in the transverse direction of the web (19);

d) feeding the web (19) in a continuous conveying motion to one of plural blank-forming units (31) of the packaging machine (22);

e) within the blank-forming unit (69), first embossing the web (19) to form plural folding lines (16, 17) of the blanks (10) to be produced, said plural folding lines comprising longitudinal folding lines (16) running transverse to the longitudinal direction of the web (19) and transverse folding lines (17) running in the direction of the web (19);

f) thereafter, making punched-out lines (18) in the web (19) to form folding tabs and, at the same time, a transverse severing cut (32) which is made in such a way that residual web connections (71) remain between adjacent blanks (10), thus resulting in a web (70) of joined blanks (10);

g) choosing the web (19) to be greater in width than the longitudinal dimension of the blanks (10), producing contours of the blanks (10) on both longitudinal edges of the web (19) by contoured longitudinal cuts (34, 35), and cutting off corresponding residual pieces (61, 62) of the web while the punched-out lines (18) are made; and h) feeding the web of blanks (70), formed from connected blanks (10) in a region of the blanks-forming unit (69), to a severance assembly (72) where the blanks (10) are separated from the web (70); and i) directly feeding the blanks separated from the web (70) to a rotary folding unit (74) of the packaging machine (22).

4. The method according to claim 3, wherein the blanks are separated from the web (70) in pairs of blanks (73), and further comprising the steps of:

feeding the pairs of blanks (73) to the rotary folding unit (74); and severing the pairs of blanks (73) from one another when the blanks (10) are fed into the rotary folding unit (74).

* * * * *